US009153160B2

(12) United States Patent
Hong et al.

(10) Patent No.: US 9,153,160 B2
(45) Date of Patent: Oct. 6, 2015

(54) ORGANIC LIGHT EMITTING DIODE DISPLAY DEVICE WITH DATA MODULATOR AND A METHOD FOR DRIVING THE SAME

(71) Applicants: LG DISPLAY CO., LTD., Seoul (KR); INDUSTRY-ACADEMIC COOPERATION FOUNDATION OF KYUNGHEE UNIVERSITY, Yongin-si (KR)

(72) Inventors: Soon-Kwang Hong, Daegu (KR); Chang-Hoon Jeon, Paju-si (KR); Keun-Choul Kim, Paju-si (KR); Byung-Hwee Park, Daegu (KR); Seung-Woo Lee, Seoul (KR); Jong-Bin Kim, Seoul (KR); Min-Koo Kim, Seoul (KR)

(73) Assignees: LG DISPLAY CO., LTD., Seoul (KR); INDUSTRY-ACADEMIC COOPERATION FOUNDATION OF KYUNGHEE UNIVERSITY, Yongin-Si (KR)

( * ) Notice: Subject to any disclaimer, the term of this patent is extended or adjusted under 35 U.S.C. 154(b) by 0 days.

(21) Appl. No.: 14/101,806

(22) Filed: Dec. 10, 2013

(65) Prior Publication Data

US 2014/0160178 A1 Jun. 12, 2014

(30) Foreign Application Priority Data

Dec. 11, 2012 (KR) ..... 10-2012-0143940

(51) Int. Cl.

| | |
|---|---|
| ***G09G 5/10*** | (2006.01) |
| ***G09G 3/20*** | (2006.01) |
| ***G09G 3/32*** | (2006.01) |

(52) U.S. Cl.

CPC ..... *G09G 3/2007* (2013.01); *G09G 3/3258* (2013.01)

(58) Field of Classification Search

CPC ..... G09G 3/3258
USPC ..... 345/690, 80
See application file for complete search history.

(56) References Cited

U.S. PATENT DOCUMENTS

| | | | | |
|---|---|---|---|---|
| 2007/0024558 | A1 | 2/2007 | Oura | |
| 2008/0001974 | A1* | 1/2008 | Kim et al. | 345/690 |
| 2008/0024398 | A1* | 1/2008 | Hwang | 345/60 |
| 2009/0160880 | A1* | 6/2009 | Park et al. | 345/690 |
| 2009/0289961 | A1 | 11/2009 | Kim et al. | |

FOREIGN PATENT DOCUMENTS

| | | | |
|---|---|---|---|
| CN | 1905623 | A | 1/2007 |
| CN | 101114441 | A | 1/2008 |

(Continued)

OTHER PUBLICATIONS

Office Action dated Jun. 26, 2015 for corresponding Chinese Patent Application No. 201310664973.0, 13 pages.

*Primary Examiner* — Kwang-Su Yang
(74) *Attorney, Agent, or Firm* — Brinks Gilson & Lione

(57) ABSTRACT

An organic light emitting diode (OLED) display device and a method for driving the same, are capable of achieving an enhancement in response characteristics of OLEDs and an enhancement in display picture quality through application of an overdriving (or accelerated driving) method taking into consideration intrinsic response characteristics of OLEDs. The OLED display device includes an image display panel including a plurality of pixel regions, and a driving integrated circuit for converting digital image data into an analog image signal, generating a plurality of gamma voltage levels through modulation, for overdriving or accelerated driving of the analog image signal, and modulating gray levels of the digital image data such that the modulated gray levels correspond to the modulated gamma voltage levels, for display of an image according to the modulated image data on the image display panel.

8 Claims, 7 Drawing Sheets

(56) References Cited

FOREIGN PATENT DOCUMENTS

| | | | |
|---|---|---|---|
| CN | 101465096 | A | 6/2009 |
| CN | 101587694 | A | 11/2009 |
| EP | 1 748 413 | A1 | 1/2007 |
| JP | 2007-033864 | | 2/2007 |
| JP | 2008-015123 | | 1/2008 |
| JP | 2008-033332 | | 2/2008 |
| JP | 2008-268503 | | 11/2008 |

* cited by examiner

ORGANIC LIGHT EMITTING DIODE DISPLAY DEVICE WITH DATA MODULATOR AND A METHOD FOR DRIVING THE SAME

This application claims the benefit of priority to Korean Patent Application No. 10-2012-0143940, filed on Dec. 11, 2012 which is hereby incorporated by reference as if fully set forth herein.

BACKGROUND

1. Field of the Disclosure

The present disclosure relates to an organic light emitting diode (OLED) display device and a method for driving the same, which are capable of achieving an enhancement in response characteristics of OLEDs and an enhancement in display picture quality through application of an overdriving (or accelerated driving) method taking into consideration intrinsic response characteristics of OLEDs.

2. Discussion of the Related Art

Recently-highlighted flat panel display devices include a liquid crystal display (LCD) device, a field emission display (FED) device, a plasma display panel (PDP) device, an organic light emitting diode (OLED) display device, etc. Among such flat panel display devices, the OLED display device is usefully applied to mobile communication appliances such as smartphones or tablet computers because it exhibits high brightness, and employs a low drive voltage while having an ultra-slim structure.

Such an OLED display device includes a plurality of pixels, each of which includes an OLED pixel constituted by an anode, a cathode, and an organic light emitting layer interposed between the anode and the cathode, and a pixel circuit for independently driving the OLED pixel. The OLED display device also includes a driving control circuit for independently controlling driving of the pixel circuits of the pixels. Such an OLED display device converts digital data into analog image signals (current or voltage signals), using grayscale-based gamma voltages, and supplies the converted image signals to respective pixel circuits and, as such, an image is displayed through the OLED pixels.

There are conventional OLED display devices or LCD devices employing an overdriving (or accelerated driving) method in which image data to be displayed is modulated in order to reduce response time of pixels. In a conventional overdriving method, image data of a current frame is compared with image data of a previous frame, and the current frame image data is modulated in accordance with a difference between the current frame image data and the previous frame image data.

However, conventional OLED display devices have a limitation in improving response characteristics, using the above-mentioned conventional overdriving method, because OLEDs have intrinsic response characteristics, differently than liquid crystals.

In detail, LCD devices exhibit rapid response characteristics when image conversion is generated from a dark low-grayscale image (0-grayscale) into a bright high-grayscale image (255-grayscale). In such an LCD device, it may be possible to improve response characteristics only through modulation of an image data value into a lower or higher value. However, OLED exhibits very slow response characteristics when image conversion is generated from a dark low-grayscale image (0-grayscale) into a bright high-grayscale image (255-grayscale), differently than liquid crystals. Furthermore, there is a limitation in improving response characteristics of such an OLED through a conventional method of increasing or decreasing an image data value because the response characteristics of the OLED are also influenced by accumulated image data. For example, a data value of about 219-grayscale is required as an overdriving data value for display of an image in a state of being converted from a low-grayscale image (0-grayscale) into an intermediate-grayscale image (112-grayscale). For conversion from a low-grayscale image (0-grayscale) into a high-grayscale image (12-grayscale) having higher grayscale than the intermediate grayscale, however, even a maximum grayscale, namely, 255-grayscale, is insufficient to improve the response characteristics.

SUMMARY

An organic light emitting diode display device includes an image display panel comprising a plurality of pixel regions, and a driving integrated circuit for converting digital image data into an analog image signal, generating a plurality of gamma voltage levels through modulation, for overdriving or accelerated driving of the analog image signal, and modulating gray levels of the digital image data such that the modulated gray levels correspond to the modulated gamma voltage levels, for display of an image according to the modulated image data on the image display panel.

In another aspect, a method for driving an organic light emitting diode display device includes displaying an image through an image display panel including a plurality of pixel regions, and converting digital image data into an analog image signal, generating a plurality of gamma voltage levels through modulation, for overdriving or accelerated driving of the analog image signal, and modulating gray levels of the digital image data such that the modulated gray levels correspond to the modulated gamma voltage levels, for driving of an image according to the modulated image data to display the image on the image display panel.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION OF THE EXEMPLARY EMBODIMENTS

Reference will now be made in detail to the preferred embodiments of the present invention associated with an organic light emitting diode display device and a method for driving the same, examples of which are illustrated in the accompanying drawings.

Figure 1:
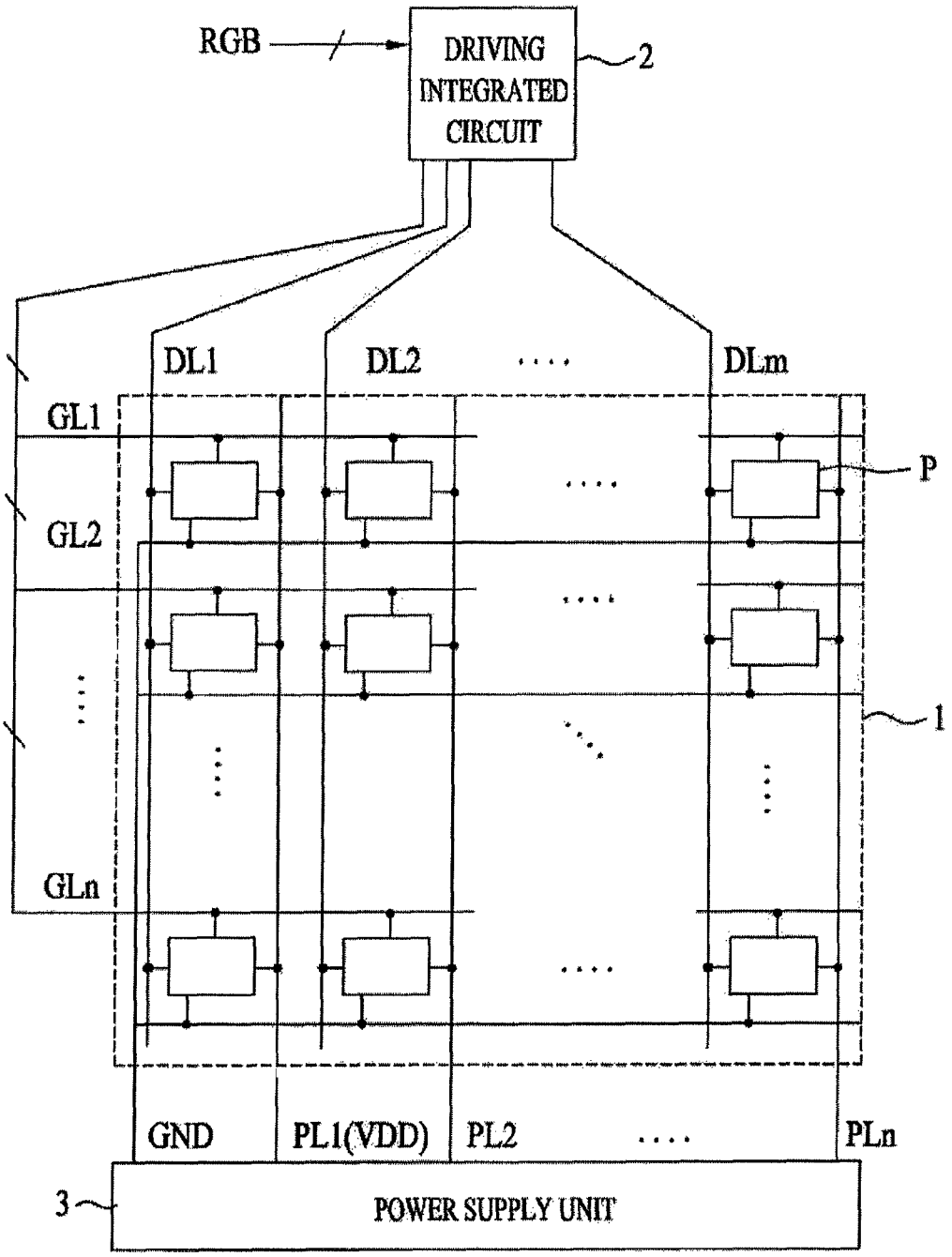
FIG. 1 is a block diagram illustrating an organic light emitting diode (OLED) display device according to an exemplary embodiment of the present invention.

FIG. 1 is a block diagram illustrating an organic light emitting diode (OLED) display device according to an exemplary embodiment of the present invention.

As illustrated in FIG. 1, the OLED display device, which may be applied to a mobile communication appliance, includes an image display panel 1 including a plurality of pixel regions, and a power supply unit 43 for applying first and second power signals VDD and GND to power lines PL1 to PLm of the image display panel 1. The OLED display device also includes a driving integrated circuit 2 for converting digital image data RGB into an analog image signal. The driving integrated circuit 2 also generates a plurality of gamma voltage levels through modulation, for overdriving (or accelerated driving) of the analog image signal. In addition, the driving integrated circuit 2 modulates gray levels of the digital image data RGB such that the modulated gray levels correspond to the generated gamma voltage levels, for display of an image according to the modulated image data on the image display panel 1.

The pixel regions of the image display panel 1 are arranged in the form of a matrix array, and a plurality of sub-pixels P is arranged in each pixel region, to display an image. Each sub-pixel P includes an organic light emitting diode (OLED), and a diode driving circuit for independently driving the OLED. In detail, the diode driving circuit of each sub-pixel P is connected to one gate line GL, one data line DL, and one power line PL. The OLED of each sub-pixel P is connected between the diode driving circuit of the sub-pixel P and the second power signal GND. The diode driving circuit of each sub-pixel P supplies, to the OLED of the sub-pixel P, an analog image signal from an associated one of the data lines DL1 to DLm to which the diode driving circuit is connected, and maintains a light emission state of the OLED through charging of the supplied analog image signal.

The driving integrated circuit 2 generates gate control signals to drive gate lines GL1 to GLn, using at least one synchronizing signal (for example, a dot clock DCLK, a horizontal synchronizing signal Hsync, a vertical synchronizing signal Vsync, and a data enable signal DE). Using the gate control signals, the driving integrated circuit 2 sequentially generates and outputs gate-on signals (for example, gate voltages having a low or high logic value). The gate-on signals are sequentially supplied to the gate lines GL1 to GLn through control of pulse widths of the gate-on signals by the driving integrated circuit 2. A gate-off voltage (for example, a gate voltage having a high logic value) is supplied to the gate lines GL1 to GLn when no gate-on voltage is supplied to the gate lines GL1 to GLn. Accordingly, the driving integrated circuit 2 drives the diode driving circuits connected to the gate lines GL1 to GLn in units of one gate line GL.

In addition, the driving integrated circuit 2 modulates a plurality of gamma voltage levels, and generates the modulated gamma voltage levels to supply analog image signals to data lines DL1 to DLm in an overdriven (or acceleratedly driven) state. The driving integrated circuit 2 also modulates the digital image data RGB such that the modulated digital image data RGB corresponds to the plural modulated gamma voltage levels. In other words, the driving integrated circuit 2 employs an overdriving method in which even the grayscale values of digital image data RGB are modulated in addition to modulation of analog image signal levels (or a plurality of gamma voltage levels) to be supplied to the data lines DL1 to DLm, because there is a limitation in improving response characteristics, using an overdriving method for modulating only the grayscale values of digital image data RGB.

To this end, the driving integrated circuit 2 should set a plurality of gamma voltage levels through modulation, for overdriving of analog image signals. Plural gamma voltage levels may be set between a minimum gamma voltage, namely, a 0-grayscale voltage, and a predetermined reference voltage (for example, a 191-grayscale gamma voltage), for display of image data, to which overdriving is not applied. In other words, the predetermined reference voltage (for example, the 191-grayscale gamma voltage) is again set as a maximum gamma voltage level and as such, image data is displayed, using voltage levels between the 0-grayscale voltage and the 191-grayscale gamma voltage. On the other hand, gamma voltage levels between a gamma voltage (for example, a 192-grayscale gamma voltage) higher than the predetermined reference voltage and a maximum gamma voltage, namely, a 255-grayscale gamma voltage, may be set, for display of image data, to which overdriving is applied. That is, the predetermined reference voltage (for example, the 191-grayscale gamma voltage) is set to correspond to a maximum grayscale voltage in conventional cases (for example, a 255-grayscale voltage of 3.4V), and gamma voltages higher than the predetermined reference voltage are boosted to voltage levels sufficient for application of the overdriving method.

After setting the plural gamma voltage levels through modulation, the input digital image data RGB is primarily modulated, using the gamma voltages between the minimum gamma voltage, namely, the 0-grayscale voltage, and the predetermined reference voltage (for example, the 191-grayscale gamma voltage), to render all grayscales (for example, 256 grayscales of 8 bits). In this case, a frame rate control (FRC) method may be applied to primary modulation of digital image data RGB. Thereafter, secondary modulation is applied to a portion of the primarily-modulated image data, namely, image data converted from a low-grayscale image into a high-grayscale image, through application of an overdriving control (ODC) method, for modulation of data values of the image data.

The driving integrated circuit 2 then matches the secondarily-modulated data, namely, modulated data MData, with the plural gamma voltage levels modulated for overdriving, and then supplies the matched gamma voltages, namely, analog image signals, to respective data lines DL1 to DLm. In detail, the driving integrated circuit 2 latches modulated data MData obtained after the secondary modulation, and then converts the latched data into analog image signals in amount corresponding to one horizontal line at intervals of one horizontal period, and supplies the analog image signals to respective data lines DL1 to DLm. The driving integrated circuit 2 according to the present invention will be described in more detail with reference to the accompanying drawings.

The power supply unit 3 supplies the first power signal VDD and second power signal GND to the image display panel 1. Here, the first power signal VDD may mean a drive voltage for driving of light emitting diodes, and the second power signal GND may mean a ground voltage or a low voltage. Current corresponding to an image signal may flow through each sub-pixel P in accordance with a difference between the first power signal VDD and the second power signal GND.

Figure 2:
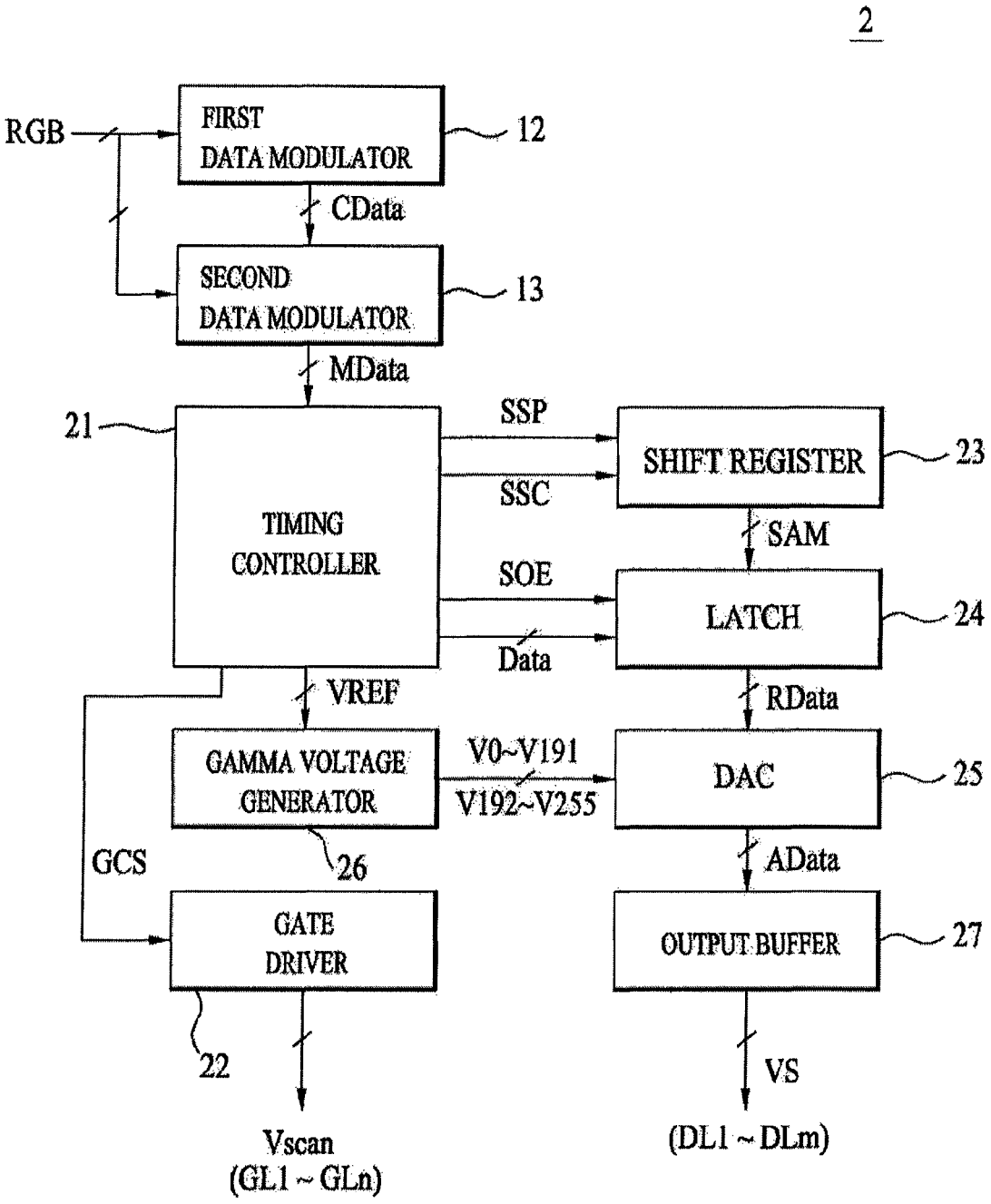
FIG. 2 is a block diagram illustrating a detailed configuration of a driving integrated circuit illustrated in FIG. 1.

FIG. 2 is a block diagram illustrating a detailed configuration of the driving integrated circuit illustrated in FIG. 1.

The driving integrated circuit 2 illustrated in FIG. 2 includes a first data modulator 12 for primarily modulating digital image data RGB in an FRC manner to render all gray levels of the digital image data RGB by gamma voltage levels between a minimum gamma voltage V0 and a predetermined reference voltage V191, and a second data modulator 13 for comparing the primarily modulated image data, namely, image data CData, with image data of a previous frame, and outputting a predetermined secondarily modulated image data MData to increase or decrease the gray levels of primarily modulated image data CData, in accordance with results of the comparison. The driving integrated circuit 2 also includes a timing controller 21 for controlling driving timing of the gate lines GL1 and GLn and driving timing of the data lines DL1 to DLm, and setting gamma voltages between the minimum gamma voltage V0 and the predetermined reference voltage V191, and gamma voltages V192 to V255 higher than the predetermined reference voltage V191 for overdriving of analog image signals VS supplied to the data lines DL1 to DLm, and a gamma voltage generator 26 for generating the gamma voltages between the minimum gamma voltage V0 and the predetermined reference voltage V191 and the gamma voltages V192 to V255 higher than the predetermined reference voltage V191 in accordance with a gamma voltage setting signal VREF from the timing controller 21.

In addition, the driving integrated circuit 2 includes a gate driver 22 for sequentially generating and outputting gate-on signals to drive respective gate lines GL1 to GLn in accordance with a gate control signal GCS from the timing controller 21, a shift register 23 for outputting a sampling signal SAM in response to a source start pulse and a source shift clock from the timing controller 21, and a latch 24 for sequentially sampling image data Data sequentially input from the timing controller 21 in accordance with the sampling signal SAM, and simultaneously outputting the sampled data, namely, data Rdata, for one line, in accordance with a source output enable signal from the timing controller 21. The driving integrated circuit 2 further includes a digital-analog converter (DAC) 25 for converting one-line data RData from the latch 24 into analog image signals AData, using gamma voltages V0 to V191 between the minimum gamma voltage V0 and the predetermined reference voltage V191 and gamma voltages V192 to V255 higher than the predetermined reference voltage V191, and outputting the converted analog image signals AData, and an output buffer 27 for amplifying the analog image signals AData from the DAC 25, and then supplying the amplified signals to respective data lines DL1 to DLm.

The timing controller 21 generates the gate control signal GCS, source shift clock SSC, source start pulse SSP, source output enable signal SOE, etc., for driving timing of the gate lines GL1 to GLn and driving timing of the data line DL1 to DLm.

In addition, the timing controller 21 sets the gamma voltage levels between the minimum gamma voltage V0 and the predetermined reference voltage V191 through modulation in order to render all gray levels (for example, 256 grayscales) of the digital image data RGB by the gamma voltage levels between the minimum gamma voltage V0 and the predetermined reference voltage V191. The timing controller 21 also sets levels of the gamma voltages V192 to V255 higher than the predetermined reference voltage V191 through modulation, and supplies gamma voltage setting signals VREF respectively corresponding to the set gamma voltage levels to the gamma voltage generator 26, for overdriving of the analog image signals VS. That is, the timing controller 21 modulates and controls the levels of the gamma voltages V0 to V191 between the minimum gamma voltage V0 and the predetermined reference voltage V191 and the gamma voltages V192 to V255 higher than the predetermined reference voltage V191 generated and output from the gamma voltage generator 26 in accordance with the gamma voltage setting signals VREF.

Figure 3A:
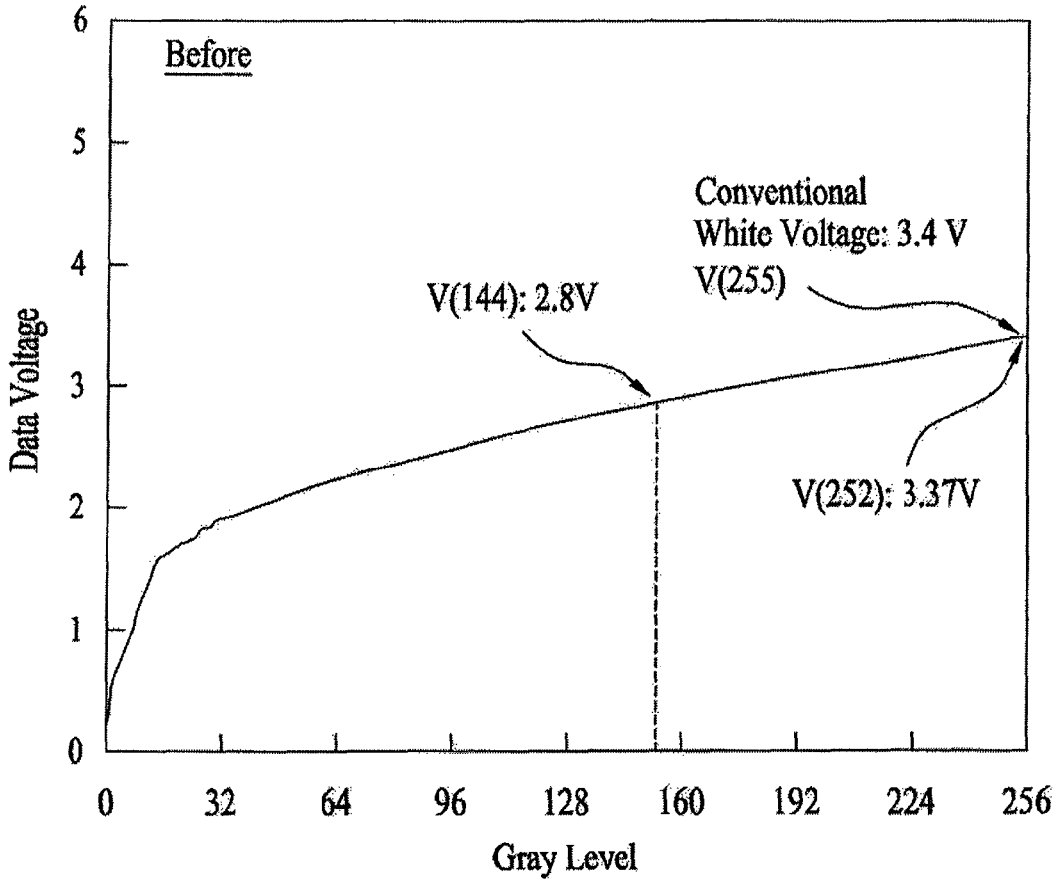
FIG. 3A is a graph depicting gamma voltage levels versus a plurality of predetermined gray levels.
Figure 3B:
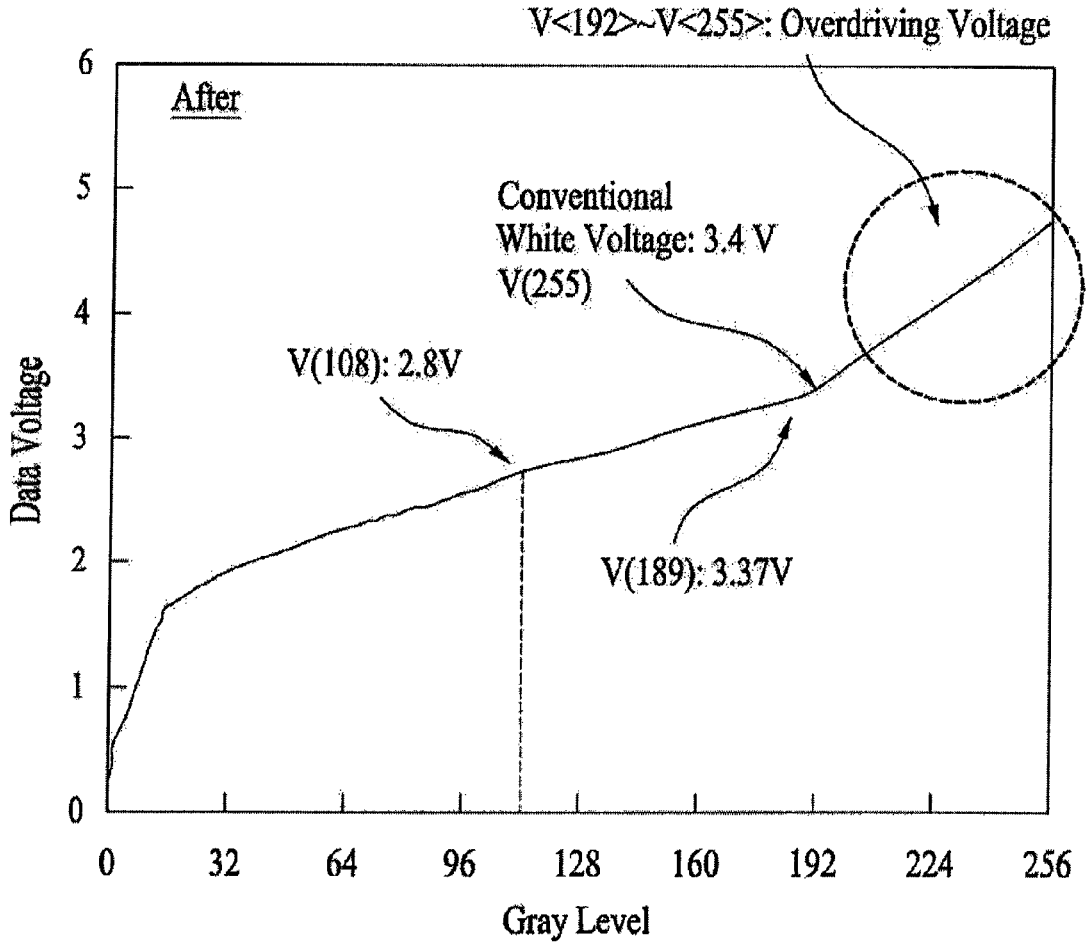
FIG. 3B is a graph depicting gamma voltage levels and overdriving voltages versus gray levels modulated by a timing controller.

FIG. 3A is a graph depicting gamma voltage levels versus a plurality of predetermined gray levels. FIG. 3B is a graph depicting gamma voltage levels and overdriving voltages versus gray levels modulated by the timing controller.

The timing controller 21 sets a plurality of gamma voltage levels V0 to V255 through modulation, for overdriving of analog image signals. As illustrated in FIG. 3B, gamma voltage levels between the minimum gamma voltage, namely, the 0-grayscale voltage V0, and the predetermined reference voltage V191 may be set to display image data, to which overdriving is not applied. On the other hand, gamma voltage levels from a gamma voltage (for example, the 192-grayscale gamma voltage) higher than the predetermined reference voltage V192 to the maximum gamma voltage, namely, the 255-grayscale voltage V255, may be set for display of image data, to which overdriving is applied. Thus, the level of the predetermined reference voltage V191 may be set to correspond to a maximum grayscale voltage (for example, 3.4V) illustrated in FIG. 3A in conventional cases, as illustrated in FIG. 3B. As the level of the predetermined reference voltage V191 is set to 3.4V through modulation, levels of the gamma voltages V1 to V190 set between the minimum gamma voltage V0 and the predetermined reference voltage V191 may be automatically set through automatic modulation, to correspond to levels between 0.01V and 3.39V. Meanwhile, the timing controller 21 sets gamma voltages (for example, V192 to V255) having higher levels than the predetermined reference voltage V191 through modulation in order to boost or lower the gamma voltages to voltage levels sufficient for application of the overdriving method.

The first data modulator 12 primarily modulates the digital image data RGB in an FRC manner, for rendering of all gray levels (for example, 256 grayscales) of the digital image data RGB by the gamma voltage levels between the minimum gamma voltage V0 and the predetermined reference voltage V191 set through modulation in the timing controller 21. The first data modulator 12 then supplies the modulated data to the second data modulator 13.

Figure 4:
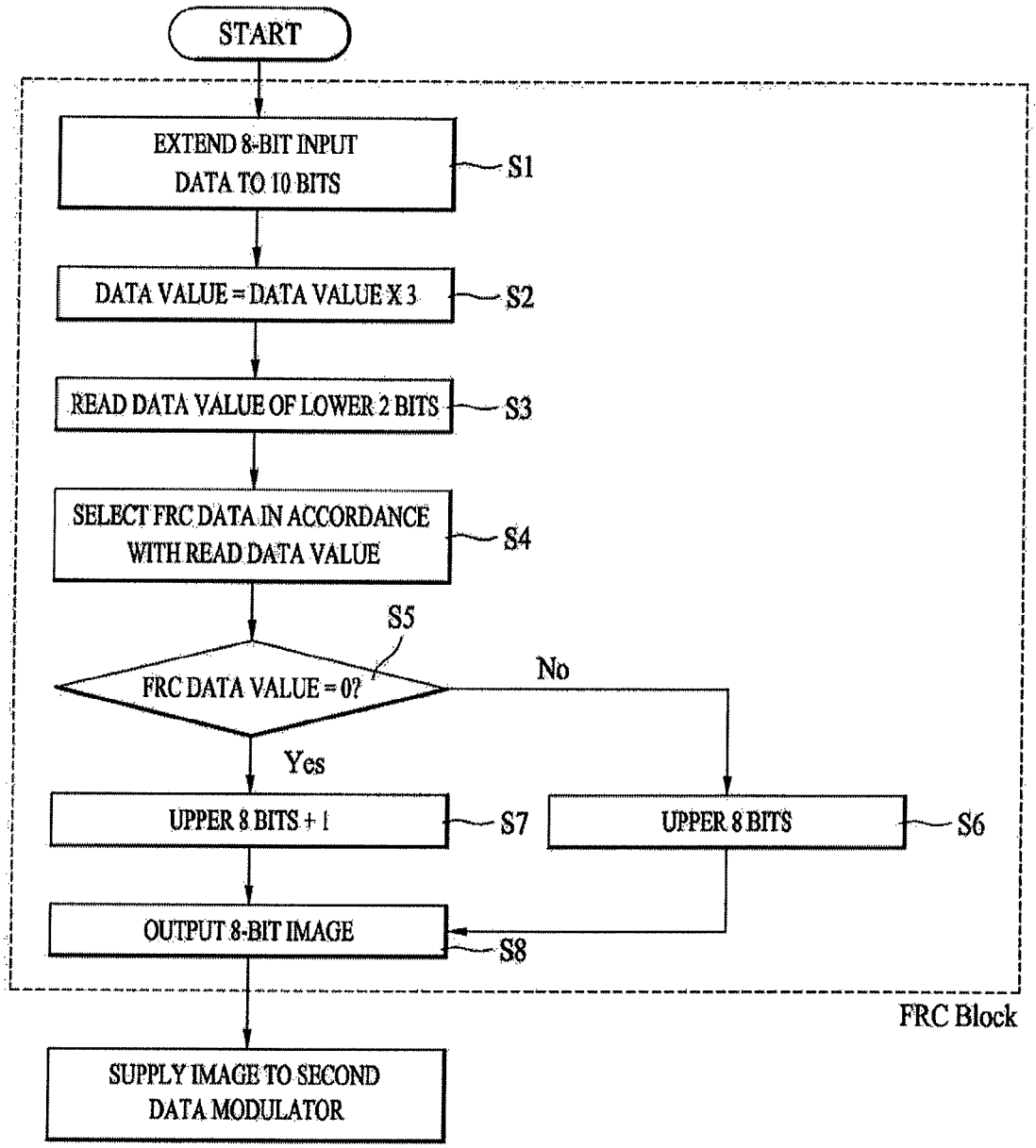
FIG. 4 is a flowchart explaining operation of a first data modulator.

The first data modulator 12 will be described in more detail with reference to FIG. 4. The first data modulator 12 extends the number of bits per pixel data of the digital image data RGB (S1), and then multiplies the resultant data by a predetermined constant to generate per-pixel extended data (S2), for rendering of all gray levels of the digital image data RGB by the gamma voltage levels between the minimum gamma voltage V0 and the predetermined reference voltage V191. In accordance with a value of lower 2 bits of the per-pixel extended data, the first data modulator 12 selects FRC data, and compares the per-pixel extended data with the selected FRC data (S3, S4). In accordance with results of the comparison (S5), the first data modulator 12 reduces the number of bits of the per-pixel extended data, and then modulates the resultant data (S6, S7) to generate the above-described primarily modulated data CData (S8).

Figure 5:
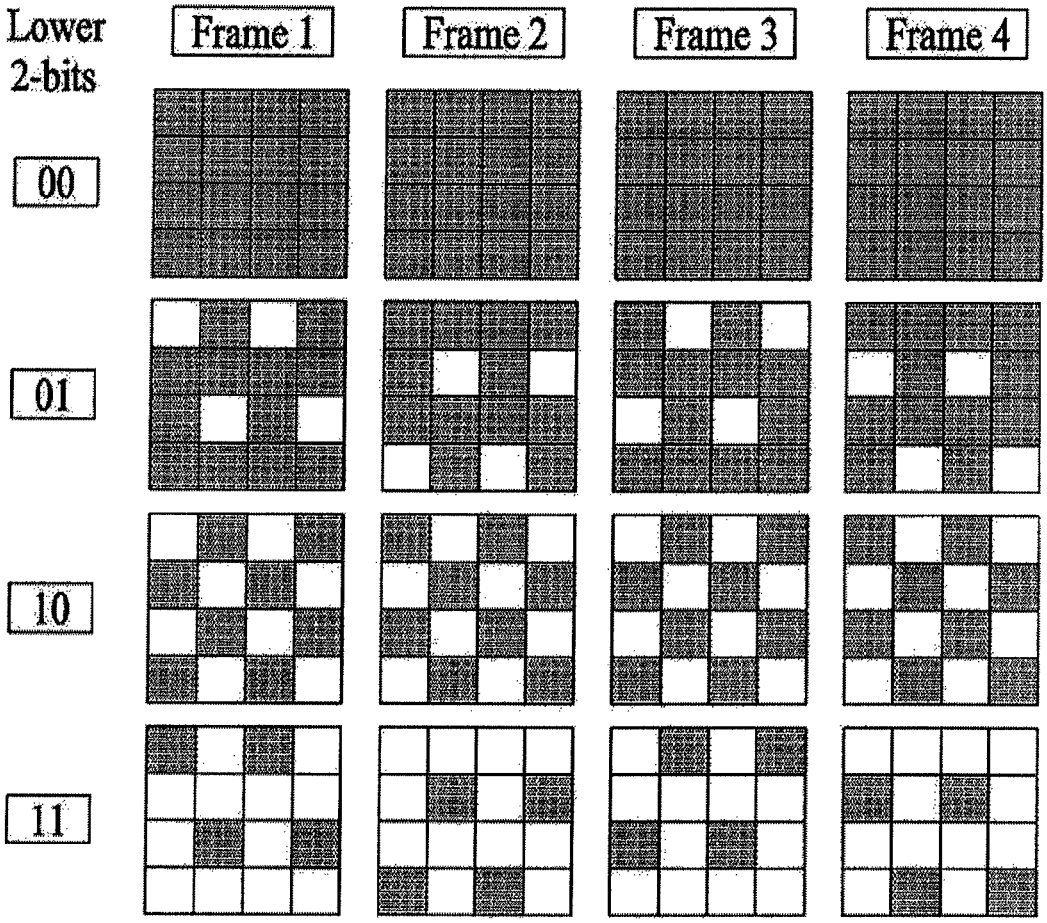
FIG. 5 is a diagram illustrating a portion of frame rate control (FRC) data.

For example, when the digital image data RGB has 256 grayscale information of 8 bits, the first data modulator 12 extends the number of bits per pixel data of the digital image data RGB to 10 bits (S1), and then multiplies the resultant data by a predetermined constant, namely, 3, to generate per-pixel extended data (S2). In accordance with a value of lower 2 bits of the per-pixel extended data, the first data modulator 12 then selects FRC data as illustrated in FIG. 5. Thereafter, the first data modulator 12 compares the per-pixel extended data with the selected FRC data. Selection of FRC data is carried out in accordance with the order of the current frame (Frame 1 to Frame 4) and the value of the lower 2 bits. Subsequently, it is detected, from the selected FRC data, whether the value of the FRC data corresponding to the current pixel data is "0" (for example, a black pixel) or "1" (for example, a white pixel). In this case, when the detected value of the FRC data is 1, the first data modulator 12 executes reduction of the number of bits and modulation by adding 1 to the upper 8 bits of the per-pixel extended data. On the other hand, when the detected value of the FRC data is 0, the first data modulator 12 executes reduction of the number of bits and modulation by outputting only the upper 8 bits of the per-pixel extended data. Thus, the first data modulator 12 outputs the above-described primarily modulated data CData. The primarily modulated data CData may render 256 grayscales, using only the gamma voltage levels between the minimum gamma voltage V0 and the predetermined reference voltage V191 set through modulation in the timing controller 21.

Figure 6:
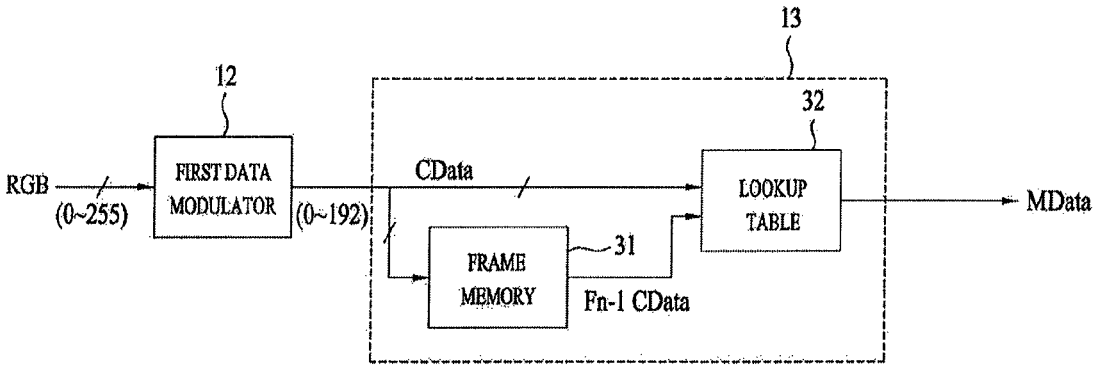
FIG. 6 is a block diagram illustrating a detailed configuration of a second data modulator illustrated in FIG. 2.

FIG. 6 is a block diagram illustrating a detailed configuration of the second data modulator illustrated in FIG. 2.

The second data modulator 13 of FIG. 6 includes a frame memory 31 for storing and outputting image data Fn-1 CData of a previous frame, and a lookup table 32 for outputting predetermined secondarily modulated image data MData to increase or decrease the gray level of the primarily modulated image data CDate in accordance with results of a comparison between the previous frame image data Fn-1 CData and the primarily modulated image data CData.

The frame memory 31 stores the primarily modulated image data CData from the first data modulator 12 on a per frame basis, and then supplies the stored image data CData to the lookup table 32.

As illustrated in the following Table 1, the lookup table 32 outputs predetermined secondarily modulated image data MData in accordance with results of the comparison between the previous frame image data Fn-1 CData and the primarily modulated image data CData. When the modulated image data CData of the current frame is different from the previous frame modulated image data Fn-1 CData, the lookup table 32 outputs an overdriving-applied data value. On the other hand, when the current frame modulated image data CData is identical to the previous frame modulated image data Fn-1 CData, the lookup table 32 outputs the current frame modulated image data CData without change.

TABLE 1

| | CF | | | | | | | | |
|---|---|---|---|---|---|---|---|---|---|
| PF | 0 | 32 | 64 | 96 | 128 | 160 | 192 | 224 | 255 |
| 0 | 0 | 57 | 111 | 158 | 208 | 251 | 255 | 255 | 255 |
| 32 | 0 | 32 | 71 | 107 | 148 | 185 | 223 | 255 | 255 |
| 64 | 0 | 32 | 64 | 100 | 138 | 175 | 212 | 255 | 255 |
| 96 | 0 | 32 | 64 | 96 | 133 | 169 | 206 | 255 | 255 |
| 128 | 0 | 32 | 64 | 96 | 128 | 165 | 201 | 255 | 255 |
| 160 | 0 | 32 | 64 | 96 | 128 | 160 | 196 | 255 | 255 |
| 192 | 0 | 32 | 64 | 96 | 128 | 160 | 192 | 255 | 255 |
| 224 | 0 | 32 | 64 | 96 | 128 | 160 | 192 | 224 | 255 |
| 255 | 0 | 32 | 64 | 96 | 128 | 160 | 192 | 224 | 255 |

For example, when a 0-grayscale image having the minimum gray level is displayed in a state of being converted into a 160-grayscale image having an intermediate gray level, a data value of 251-grayscale may be output as overdriving data. The reason why the grayscale of the overdriven data exceeds the data value of 191-grayscale corresponding to the predetermined reference gamma voltage is to display an image in a state of being modulated into a target gray level within one frame period.

Meanwhile, the shift register 23 of FIG. 2 generates a sampling signal SAM, using a source shift clock SSC and a source start pulse SSP from the timing controller 21. In detail, the shift register 23 shifts the source start pulse SSP in accordance with the source shift clock SSC in order to generate the sampling signal SAM, and supplies the sampling signal SAM to the latch 24 in a sequential manner.

The latch 24 sequentially samples the image data Data supplied from the timing controller 21 in accordance with the sampling signal SAM from the shift register 23. The latch 24 stores the sampled data in units of one line, and simultaneously outputs, to the DAC 25, the latched image data, namely, image data Rdata, for one line, in response to a source output enable signal SOE.

The gamma voltage generator 26 generates the gamma voltages V0 to V191 between the minimum gamma voltage V0 and the predetermined reference voltage V191 and the gamma voltages V192 to V255 higher than the predetermined reference voltage V191 in accordance with a gamma voltage setting signal VREF from the timing controller 21.

The DAC 25 converts the digital data signal RData into analog image data AData, using the gamma voltages V0 to V191 between the minimum gamma voltage V0 and the predetermined reference voltage V191 and the gamma voltages V192 to V255 higher than the predetermined reference voltage V191. The DAC 25 then simultaneously outputs the converted analog image data AData for one line to the output buffer 27.

In detail, the DAC 25 converts the digital image data RData from the latch 24 into analog image data AData through selection of gamma voltages having levels respectively corresponding to the digital image data RData, namely, one or more gamma voltages from the gamma voltages V0 to V191 between the minimum gamma voltage V0 and the predetermined reference voltage V191 and the gamma voltages V192 to V255 higher than the predetermined reference voltage V191.

In order to prevent the analog image data AData from the DAC 25 from being distorted due to RC time constants of the data lines DL1 to DLm, the output buffer 27 amplifies the analog image data AData. The output buffer 27 then supplies amplified signals VS to respective data lines DL1 to DLm.

As apparent from the above description, the OLED display device according to the illustrated embodiment of the present invention employs an overdriving method in which even the grayscale values of digital image data RGB are modulated in addition to modulation of analog image signal levels to be supplied to the data lines DL1 to DLm, taking into consideration intrinsic response characteristics of OLEDs, differently than an overdriving method in which only the grayscale values of digital image data RGB are modulated. Thus, in accordance with the present invention, it may be possible to achieve an enhancement in response characteristics of OLEDs and an enhancement in display picture quality through application of an overdriving (or accelerated driving) method taking into consideration intrinsic response characteristics of OLEDs.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting diode display device comprising:

an image display panel comprising a plurality of pixel regions; and a driving integrated circuit that converts digital image data into an analog image signal, generates a plurality of gamma voltage levels through modulation, for overdriving or accelerated driving of the analog image signal, and modulates gray levels of the digital image data such that the modulated gray levels correspond to the modulated gamma voltage levels, for display of an image according to the modulated image data on the image display panel, wherein the driving integrated circuit comprises:

a first data modulator that primarily modulates the digital image data in a frame rate control (FRC) manner to render all gray levels of the digital image data by gamma voltage levels between a minimum gamma voltage and a predetermined reference voltage;

a second data modulator that compares the primarily modulated image data with image data of a previous frame, and outputs a predetermined secondarily modulated image data in accordance with results of the comparison;

a timing controller that controls driving timing of gate lines and driving timing of data lines, and sets gamma voltages between the minimum gamma voltage and the predetermined reference voltage, and gamma voltages higher than the predetermined reference voltage; and a gamma voltage generator that generates the gamma voltages between the minimum gamma voltage and the predetermined reference voltage and the gamma voltages higher than the predetermined reference voltage in accordance with a gamma voltage setting signal from the timing controller.

2. The organic light emitting diode display device according to claim 1, wherein:

the timing controller sets the gamma voltage levels between the minimum gamma voltage and the predetermined reference voltage through modulation, for rendering of all gray levels of the digital image data by the gamma voltage levels between the minimum gamma voltage and the predetermined reference voltage;

the timing controller sets levels of the gamma voltages higher than the predetermined reference voltage through modulation;

the timing controller supplies gamma voltage setting signals respectively corresponding to the set gamma voltage levels to the gamma voltage generator, for modulation and control of the levels of the gamma voltages between the minimum gamma voltage and the predetermined reference voltage and the gamma voltages higher than the predetermined reference voltage generated and output from the gamma voltage generator in accordance with the gamma voltage setting signals.

3. The organic light emitting diode display device according to claim 2, wherein:

the first data modulator extends the number of bits per pixel data of the digital image data, and multiplies resultant data obtained after the bit extension by a predetermined constant to generate per-pixel extended data, for rendering of all gray levels of the digital image data by the gamma voltage levels between the minimum gamma voltage and the predetermined reference voltage; and the first data modulator selects frame rate control (FRC) data in accordance with a value of lower 2 bits of the per-pixel extended data, compares the per-pixel extended data with the selected FRC data, reduces the number of bits of the per-pixel extended data, and then modulates resultant data obtained after the bit reduction to generate the primarily modulated image data.

4. The organic light emitting diode display device according to claim 3, wherein the second data modulator comprises:

a frame memory that stores and outputs image data of a previous frame; and a lookup table that outputs the predetermined secondarily modulated image data to increase or decrease a gray level of the primarily modulated image data in accordance with the results of the comparison between the previous frame image data and the primarily modulated image data.

5. A method for driving an organic light emitting diode display device comprising:

displaying an image through an image display panel including a plurality of pixel regions; and converting digital image data into an analog image signal, generating a plurality of gamma voltage levels through modulation, for overdriving or accelerated driving of the analog image signal, and modulating gray levels of the digital image data such that the modulated gray levels correspond to the modulated gamma voltage levels, for driving of an image according to the modulated image data to display the image on the image display panel, wherein the driving of the image according to the modulated image data to display the image on the image display panel comprises:

primarily modulating the digital image data in a frame rate control (FRC) manner to render all gray levels of the digital image data by gamma voltage levels between a minimum gamma voltage and a predetermined reference voltage;

comparing the primarily modulated image data with image data of a previous frame, and outputting a predetermined secondarily modulated image data in accordance with results of the comparison;

controlling driving timing of gate lines and driving timing of data lines, and setting gamma voltages between the minimum gamma voltage and the predetermined reference voltage, and gamma voltages higher than the predetermined reference voltage; and generating the gamma voltages between the minimum gamma voltage and the predetermined reference voltage and the gamma voltages higher than the predetermined reference voltage.

6. The method according to claim 5, wherein the setting the gamma voltages between the minimum gamma voltage and the predetermined reference voltage, and the gamma voltages higher than the predetermined reference voltage comprises:

setting the gamma voltage levels between the minimum gamma voltage and the predetermined reference voltage through modulation, for rendering of all gray levels of the digital image data by the gamma voltage levels between the minimum gamma voltage and the predetermined reference voltage;

setting levels of the gamma voltages higher than the predetermined reference voltage through modulation, and generating and outputting gamma voltage setting signals respectively corresponding to the set gamma voltage levels; and modulating and controlling the levels of the gamma voltages between the minimum gamma voltage and the predetermined reference voltage and the gamma voltages higher than the predetermined reference voltage.

7. The method according to claim 6, wherein the primarily modulating the digital image data in the frame rate control (FRC) manner comprises:

extending the number of bits per pixel data of the digital image data, and multiplying resultant data obtained after the bit extension by a predetermined constant to generate per-pixel extended data, for rendering of all gray levels of the digital image data by the gamma voltage levels between the minimum gamma voltage and the predetermined reference voltage; and selecting frame rate control (FRC) data in accordance with a value of lower 2 bits of the per-pixel extended data, comparing the per-pixel extended data with the selected FRC data, reducing the number of bits of the per-pixel extended data, and then modulating resultant data obtained after the bit reduction to generate the primarily modulated data.

8. The method according to claim 7, wherein the outputting the predetermined secondarily modulated image data comprises:

storing and outputting image data of a previous frame; and outputting the predetermined secondarily modulated image data to increase or decrease a gray level of the primarily modulated image data in accordance with the results of the comparison between the previous frame image data and the primarily modulated image data.

* * * * *